US008608580B2

(12) United States Patent
Khanna

(10) Patent No.: US 8,608,580 B2
(45) Date of Patent: Dec. 17, 2013

(54) ADJUSTABLE STAIR AND FURNITURE SLIDE

(76) Inventor: Rajeev Khanna, Beaumont Hills (AU)

( * ) Notice: Subject to any disclaimer, the term of this patent is extended or adjusted under 35 U.S.C. 154(b) by 207 days.

(21) Appl. No.: 13/315,832

(22) Filed: Dec. 9, 2011

(65) Prior Publication Data

US 2013/0150171 A1 Jun. 13, 2013

(51) Int. Cl.
*A63G 21/22* (2006.01)
*A63G 21/00* (2006.01)

(52) U.S. Cl.
USPC ..... 472/116; 297/217.1

(58) Field of Classification Search
USPC ..... 472/116, 117, 128; 297/217.1, 217.7; 482/34–36
See application file for complete search history.

(56) References Cited

U.S. PATENT DOCUMENTS

| | | | | | |
|---|---|---|---|---|---|
| 726,028 | A * | 4/1903 | Chase | 297/217.1 |
| 2,016,891 | A * | 10/1935 | Clarke | 297/217.1 |
| 2,270,909 | A * | 1/1942 | Spizer | 472/116 |
| 2,465,187 | A * | 3/1949 | Barrabee | 472/116 |
| 3,743,281 | A * | 7/1973 | Gimbel | 472/116 |
| 4,630,709 | A * | 12/1986 | Taylor | 182/48 |
| 4,943,048 | A * | 7/1990 | Hentges | 472/116 |
| 5,197,924 | A * | 3/1993 | Gerrells | 472/116 |
| 7,494,419 | B2 * | 2/2009 | Katz et al. | 472/116 |

* cited by examiner

*Primary Examiner* — Kien Nguyen
(74) *Attorney, Agent, or Firm* — McNeely, Hare & War, LLP; Simana Rao, Esq.

(57) ABSTRACT

A slide assembly for indoor/outdoor use which may be adapted to mount to a stairway or furniture piece, such as a couch or chair. The slide assembly includes two or more mounting apparatuses which pivotally mount the slide to a vertical wall adjacent to a stairway such that the slide assembly is capable of being moved from an in-use position to a folded or stowed away position. The ability to pivot the slide assembly allows the stairway to be left unobstructed and free for regular use while the slide is not being used. Similarly, the slide assembly may be mounted to a couch or chair and may be easily disassembled such that the couch may be left unobstructed and free for regular use when the slide is not being used.

20 Claims, 6 Drawing Sheets

ADJUSTABLE STAIR AND FURNITURE SLIDE

TECHNICAL FIELD

The field of the invention generally relates to a slide for children's recreational and exercise use to be supported in place on a pre-existing set of stairs and/or a furniture piece such as a couch or chair.

BACKGROUND

Stair slides have been known in the art for some time, as can be seen in U.S. Pat. No. 2,270,909 dating back to 1938. Various methods have been suggested for mounting a stair slide to a set of stairs. For example, Spizer in U.S. Pat. No. 2,270,909 suggests clamping a one piece stair slide to the stairs using clamping screws and brackets. Gimbel in U.S. Pat. No. 3,743,281 provides a stair slide structure for placement onto a set of stairs requiring each step to have a specific height and length to conform to a specifically sized stairway. Hentges in U.S. Pat. No. 4,943,048 suggests a terminus located at the end of the slide with means for resisting movement of the slide away from the stairs, such as a carpet gripper or suction cups underneath the terminus. Gerrells in U.S. Pat. No. 5,197,924 contains at least two anchor members underneath the slide which attach to the vertical portion between steps. None of these prior art slides provide a stair slide apparatus which allows for the slide to be securely mounted to a varying set of stairs while also allowing the user to put the slide into a stored or stowed position with minimum effort when the slide is not in use. Furthermore, there does not exist a slide apparatus which can be securely mounted to a piece of furniture such as a couch or chair, and is also adjustable depending on the size and shape of the furniture.

SUMMARY

In one general aspect, a slide apparatus is adapted to mount to a vertical wall located adjacent to a stairway that has an upper portion, a middle portion and a lower portion. Each of the upper portion, middle portion and lower portion of the stairway comprises one or more steps and where the upper portion of the stairway is adjacent to an upper portion of the vertical wall, the middle portion of the stairway is adjacent to a middle portion of the vertical wall, and the lower portion of the stairway is adjacent to a lower portion of the vertical wall.

The slide apparatus includes a slide member, a first mounting apparatus, and a second mounting apparatus. The slide member has along its length an upper portion, a lower portion and middle portion between the upper and lower portions. The slide member has a base and a first wall with the first wall being joined lengthwise to the base to form an angle between the base and the first wall.

The first mounting apparatus secures an upper portion of the slide member to the upper portion of the vertical wall, the first mounting apparatus being securable to the upper portion of the vertical wall and secured to the upper portion of the slide member.

The second mounting apparatus secures the lower portion of the slide member to the lower portion of the vertical wall, the second mounting apparatus being secured to the lower portion of the slide member.

The first and second mounting apparatuses allow for the pivotal movement of the slide member from a position such that the slide base is substantially parallel to the vertical wall to a position such that the slide base is substantially perpendicular to the vertical wall.

Embodiments of the slide apparatus may include one or more of the following features. For example, the slide base may have an underside surface which faces the steps when the slide member is in an in-use position substantially perpendicular to the vertical wall. The underside surface of the slide base may include one or more legs along the length of the slide member, the one or more legs being capable of extending and retracting in length such that when the slide member is in the in-use position substantially perpendicular to the vertical wall, the one or more legs are extended to be in contact with one or more steps in the upper portion, middle portion or lower portion of the stairway. When the one or more legs are extended to be in contact with the one or more steps in the upper portion, middle portion or lower portion of the stairway in the in-use orientation, the one or more legs may be oriented substantially perpendicular to the one or more steps.

The one or more legs mounted to the underside surface of the slide base may be pivotable between a position substantially perpendicular to the underside surface of the slide base and a position substantially parallel to the underside surface of the slide base.

The one or more legs may be mounted to the underside surface of the slide base in at least one or more of the upper portion, lower portion and middle portion of the slide member.

When the slide base is in a not-in-use position that is substantially parallel to the vertical wall, the one or more legs may be foldable to a position substantially parallel to the underside surface of the slide base.

The first and second mounting apparatus may individually be a hinge.

The slide apparatus may further include a third mounting apparatus arranged for securing the middle portion of the slide member to the middle portion of the vertical wall, the third mounting apparatus being secured to the middle portion of the first wall of the slide member and securable to the middle portion of the vertical wall.

The slide apparatus may further include a landing means in which the lower portion of the slide base includes a lowermost edge across a width of the slide base which is adapted to attach the landing means to the slide base. The landing means may include a cushion-like material.

In a second general aspect, the slide apparatus is adapted to mount to a couch seated on a floor surface. The couch includes a body and a cushion, with the body having a front portion, an underside lying underneath the couch, and a back portion. The cushion is removably positioned on top of the body.

The slide apparatus includes a slide member having a base and a first wall with the first wall being joined lengthwise to the base to form an angle between the base and the first wall. The slide apparatus includes one or more legs configured to attach to the first wall and one or more clamps. The one or more clamps have two end members and between these end members is a first clamp portion configured to adjustably extend across the depth of the couch along a couch underside and a second clamp portion configured to adjustably extend upwards from the first clamp portion along the front portion of the body to the top of the body. The slide apparatus includes one or more horizontal supports configured to attach on one end to the one or more legs and on the other end to the one or more clamps. During use, the first portion of the slide member rests on the cushion and the second portion of the slide member rests on the floor surface.

Embodiments of the slide apparatus may include one or more of the following features. For example, the second clamp portion may include one or more apertures adapted to receive the one or more horizontal supports.

The one or more legs may each include one or more apertures adapted to receive the one or more horizontal supports.

The one or more legs may be extendable and retractable in length.

The first wall may have one or more notches molded into a mating shape of the one or more legs such that the one or more legs can be mated with the first wall.

A third portion may lie at an angle between the first portion and the second portion when the slide apparatus is mounted to the couch.

A handle bar may be configured to attach to an upper end of the one or more legs.

The second portion of the slide member may comprise a cushion-like material.

The first portion of the slide member may have a surface comprising rubber or silicon grips to prevent the slide member from sliding off the couch cushion.

DETAILED DESCRIPTION

The slide apparatus of the present invention is designed to be mounted to any conventional staircase or furniture piece such as a couch or a chair, and is particularly useful for children to use indoors on a rainy or snowy day. The slide apparatus can also be used outdoors and can be used in a variety of other applications, such as for emergency escape use or transportation of items up or down a staircase.

Figure 1:
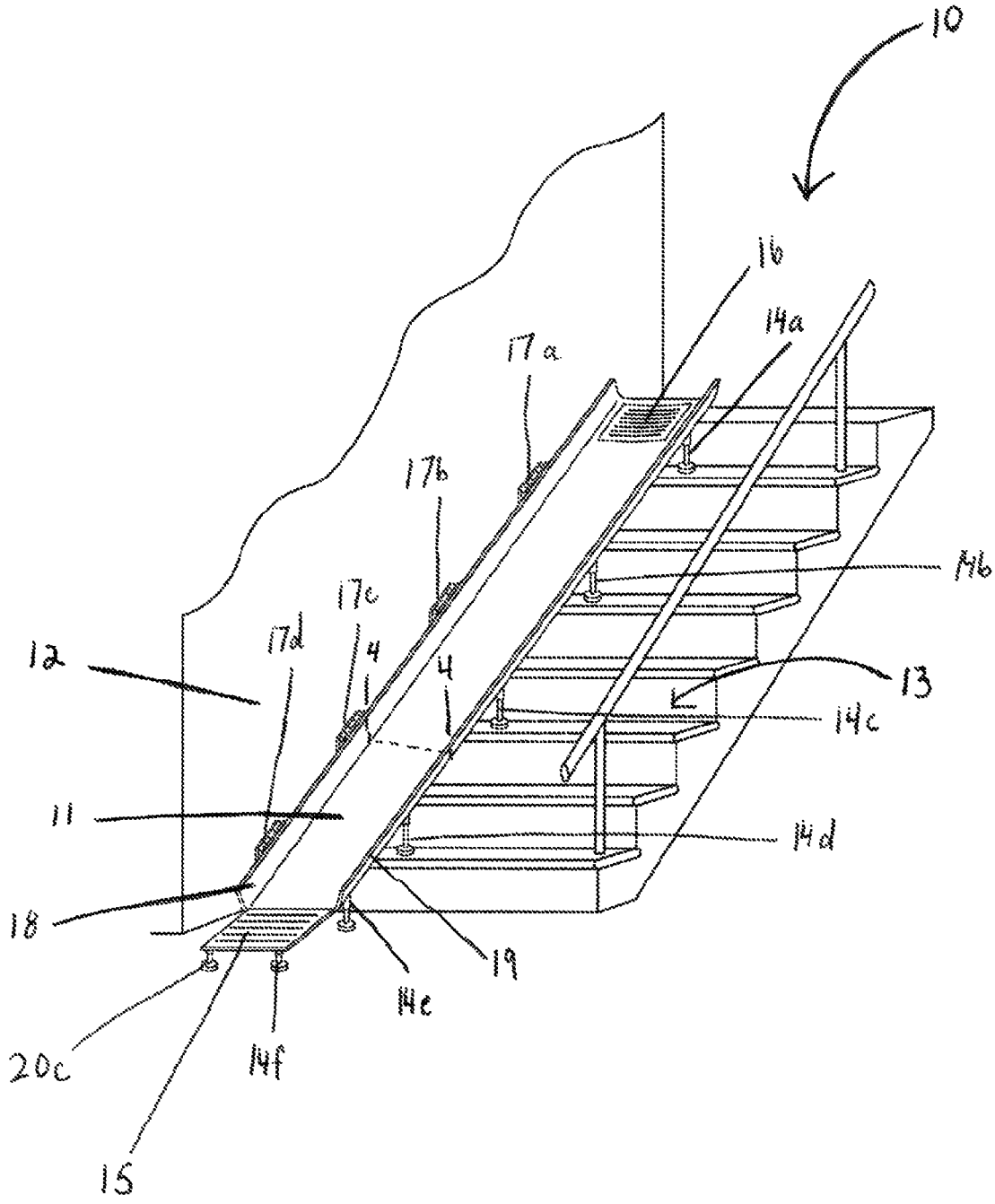
FIG. 1 illustrates a perspective view of the stair slide assembly with the slide portion oriented in an unfolded in-use position.
Figure 2:
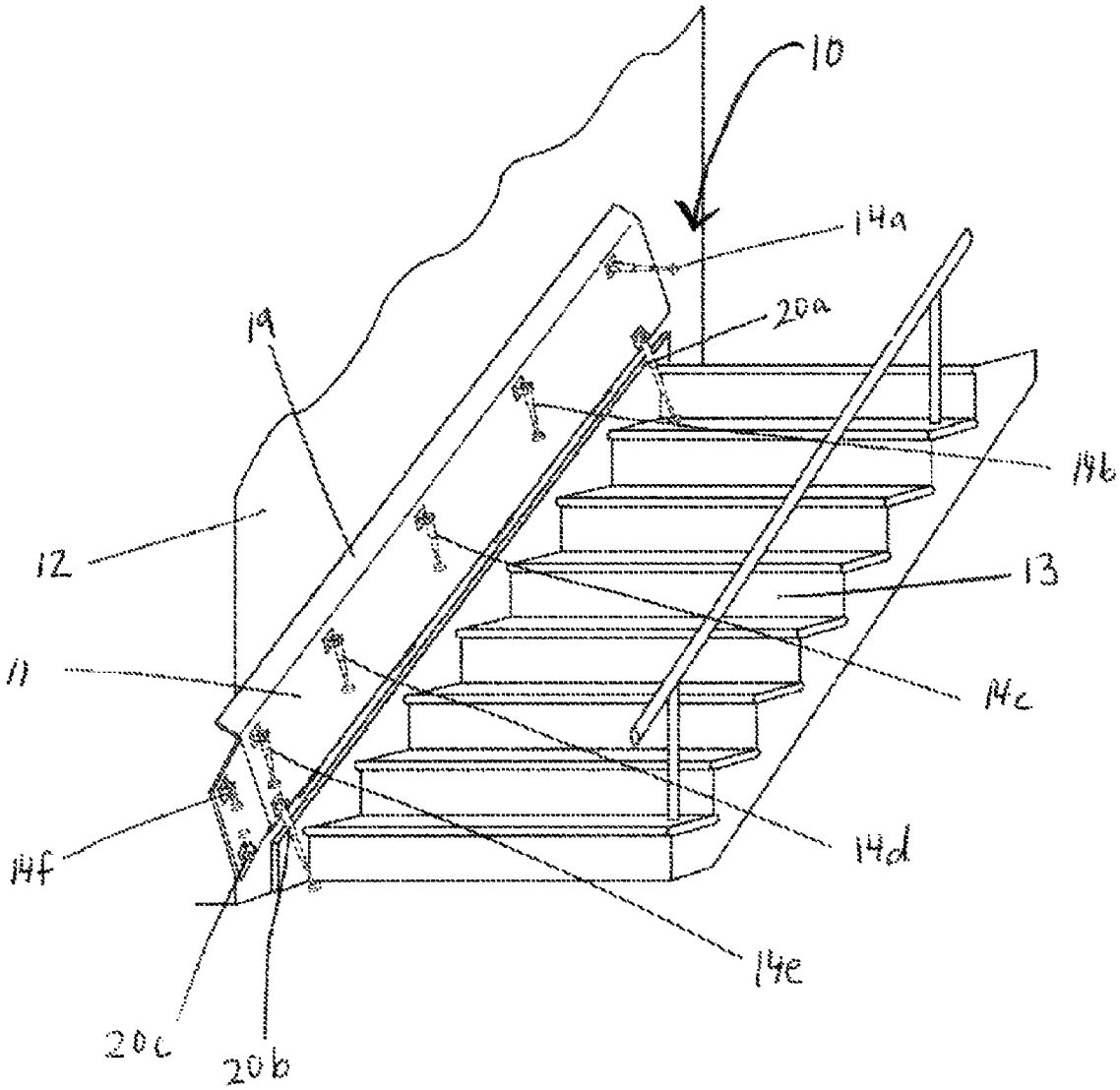
FIG. 2 illustrates a perspective view of the stair slide assembly with the slide portion oriented in a folded, stowed away position.

FIGS. 1 and 2 illustrate the stair slide assembly 10 which includes a slide 11 having an upper end and a lower end, and side walls 18 and 19 which project at an angle of from about 90° to about 170° along the length of the slide. FIG. 1 depicts the slide and side walls which form a U shape. The slide and side walls may be formed out of a single piece of material such as plastic or metal, or the three pieces may be bonded together using a welding technique, bonding glue or other conventional fastening means. The material of the slide and side walls may be the same or different, and is preferably made of a molded plastic material, a light weight metal such as steel or aluminum, an alloy material, or wood or a composite wood material. The slide 11 preferably has a smooth unobstructed surface for ease of descent of a person or object along the slide. The slide 11 may also be assembled in parts or sections for ease of packaging. When the slide 11 is provided in sections, it can be assembled by providing a slot in one piece which is configured to fit a tongue which is made part of another piece such that each piece can be fitted together to form a varying length slide.

The stair slide assembly 10 is mounted to a wall 12 adjacent to a staircase 13 using mounting apparatuses 17*a*-17*d*. As shown in FIGS. 1 and 2, staircase 13 includes one or more steps, a wall, a railing and one or more balusters/banisters. Generally the wall 12 is a vertical wall in a house or building but also can be an exterior wall of a building or other structure as desired. Mounting apparatuses 17*a*-17*d* are capable of securely fastening side wall 18 to wall 12 and allowing a limited angle of rotation or pivoting between the two surfaces (the side wall and wall) such that the stair slide assembly can be easily folded either towards the wall to a stowed away position (as in FIG. 2) or folded away from the wall to an in-use position (as in FIG. 1). The mounting apparatuses shown in FIGS. 1 and 2 are hinges secured to each surface using a threaded fastener such as a screw, however mounting apparatuses 17*a-d* may be any device known to one of ordinary skill in the art useful for mounting one object to another object permitting a pivoting relationship between the two objects. In one embodiment, the slide may be adapted to be attached to clamps mounted to the staircase, e.g., on the wall, railing or baluster/banister portion of the staircase. The mounting apparatuses may be constructed of a variety of materials including metals and plastics. As shown in FIG. 1, mounting apparatuses are secured to the slide at several points along the length of the slide, from the upper portion of the slide, which begins at the top step of the stairway, to the lower portion of the slide, which ends at the point where the floor meets the lower-most step. In between the upper portion and lower portion of the slide lies the middle portion of the slide.

Landing 15 is connected to the edge of the lower end of the slide 11. The landing may be constructed of a variety of materials, from rigid to soft. FIGS. 1 and 2 depict landing 15 having a rigid surface, such as molded plastic. When the landing is constructed of a rigid surface, a padded material may be used in conjunction with the rigid surface so as to cushion the landing of the child. The landing may also be entirely constructed of a cushion-like material, such as a cushion constructed of a cotton material or rubber material. The landing 15 may be secured to the edge of the slide 11 using either permanent and non-permanent means. Non-permanent means include Velcro®, ties, and/or snap closures positioned along the edge of the landing for mating with corresponding fasteners along the lower edge of the slide. Permanent means include a hinging apparatus mounted to the underside of the slide and landing surfaces, epoxy/glue or threaded fasteners which are screwed into each surface.

The side wall height is selected such that a child may engage each side wall as he/she descends the slide, but not too high as to impede the ability of the slide to rotate or pivot towards the wall and be maintained in the stowed position, as shown in FIG. 2. Preferred side wall height may be from about 1 inch to about 12 inches, and most preferably from about 2 inches to about 6 inches. The height of the side walls is generally specified to prevent the user from accidentally falling off the slide during use.

Stair slide assembly 10 may include a seat 16 located on the upper end of the slide 11, as depicted in FIG. 1. Seat 16 may be a gripping surface applied to the slide in order to provide friction for a child to sit before he begins his descent along the slide. For example, the gripping surface may be soft rubber material adhered to the slide surface, a ribbed material adhered to the slide surface, or the like.

Legs 14*a* to 14*e* and 20*a*-20*b* are mounted to an underside, mounting surface of slide 11 spaced along its length, as is depicted in FIG. 2. The slide preferably contains a row of legs along the length of each edge where the respective wall 18 and 19 join the slide surface 11. These legs are adjustable vertically in height (e.g., adjustable or variable length), such that the stair slide assembly can be mounted at various heights along the wall and can conform to both standard and non-standard steps having varying heights and sizes.

One or more legs may also be used to support the landing 15. As is depicted in FIGS. 1 and 2, legs 14*f* and 20*c* are mounted to the underside of landing 15 in the same manner that legs 14*a-e* and 20*a-b* are mounted.

Legs 14*a* to 14*f* and 20*a* to 20*c* are shown in FIGS. 1 and 2 as telescoping legs, however these legs may be adjustable in height by any means known to one of ordinary skill in the art, such as retracting legs resembling an accordion having a ribbed surface. The telescoping legs can be in the form of two legs, one of which is threadably retractable into the other to vary the length of the leg. The telescoping legs also can be in the form of two legs, one of which is slidably retractable into the other and includes a locking mechanism to securely fix the length. When the stairs and floor are covered in carpet, the underside of each leg may preferably have one or more grips, teeth, or other means to resist sliding on the carpeted floor. These grips may be composed of rubber and may cover either sections of the surface area or the entire surface area of the underside of each leg in contact with the floor. Alternatively, if the stairs and/or floor have a smooth surface such as hard wood or marble, suction cups may be present on the underside of each leg in order to resist sliding. A soft rubber surface will also function adequately on a hard surface.

Legs 20*a-b* are generally capable of being lengthened or extended to have a longer length to sufficiently reach the stairway or step surface to accommodate the slide being folded into a stowed away or not-in-use position. When the slide 11 is in a stowed away position, one or more legs 20*a-b* such as those depicted in FIG. 2 may be pivoted or folded downwards and extended to the preferred length such that the weight of the slide partially rests on these legs and prevents the slide from returning unintentionally to the in-use position. The act of folding legs 20*a-b* downwards and extending each leg to reach the ground allows the stair slide assembly 10 to remain in a stowed away, not-in-use position. When the slide is rotated into the stowed away position, the remaining legs 14*a-f* which are not being used for supporting the stair slide assembly may be folded in a downward direction such that the stair slide assembly remains tucked away and provides ample room for stairway traffic when it is not in use.

Legs 14*a* to 14*f* and 20*a* to 20*c* are shown in FIG. 2 as capable of being folded from a position which is perpendicular to the underside, mounting surface of the slide to a position which is parallel to the mounting surface of the slide. In another embodiment, legs 20*a-c* of the stair slide assembly are mounted in a different orientation than legs 14*a* to 14*f* as illustrated in FIG. 2 such that by the user folding legs 20*a-c* downwards towards the ground renders each leg perpendicular to the ground or step/stair it is in contact with. Although not shown in FIG. 2, these legs may also be mounted on the underside surface of the slide 11 such that the portion in contact with the underside of the slide can be rotated up to 360°. In this manner, any of the legs may be individually and precisely pivoted to a position substantially perpendicular to the ground in order to ensure optimum contact with the ground for extra support of the stair slide assembly.

The stair slide assembly is not limited to stairs and is designed to be mounted to any inclined surface having a wall adjacent to it. When the stair slide assembly is used on an inclined surface having no staircase, the legs are modified such that the underside portion of each leg adjustably pivots according to the incline of the surface the slide extends along and over.

Figure 3:
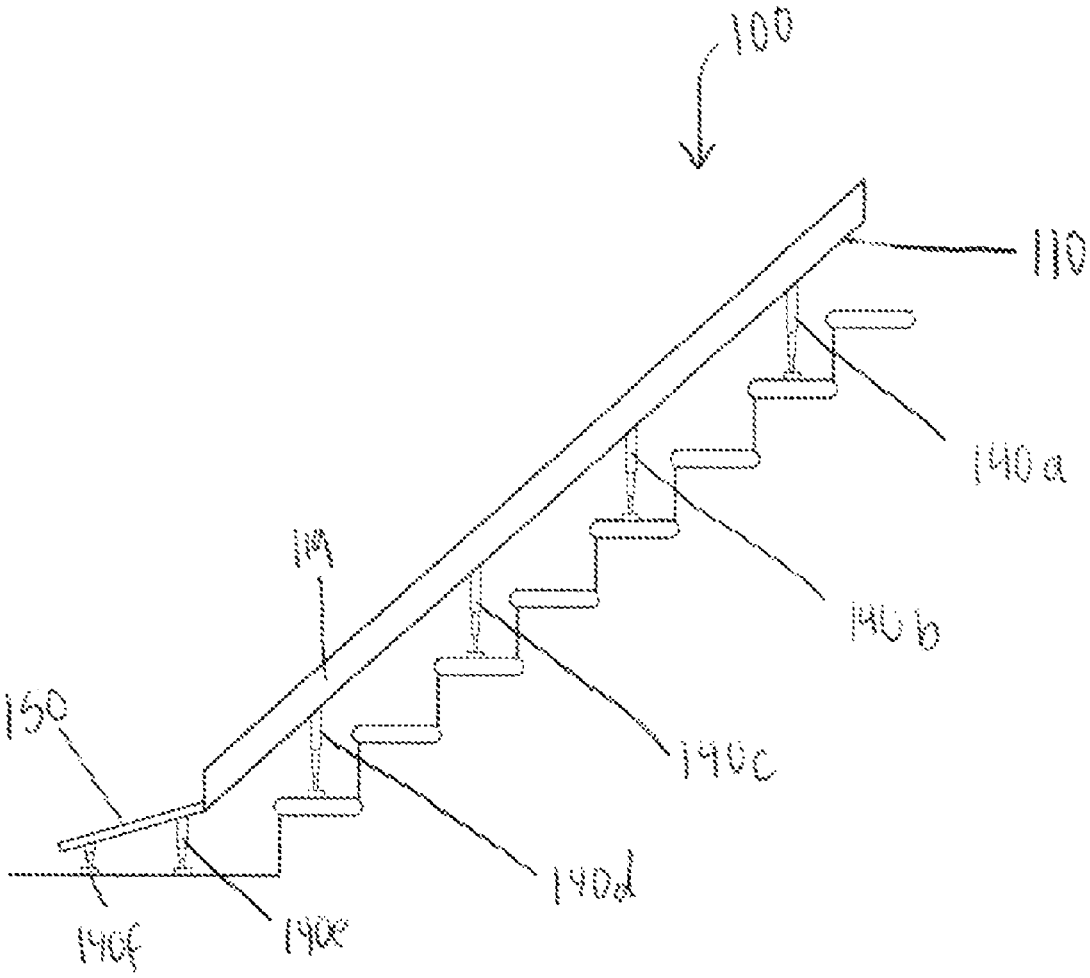
FIG. 3 illustrates a side view of the stair slide assembly being supported by one or more adjustable legs.

FIG. 3 depicts a side view of the stair slide assembly 100, which is a variation of the assembly 10 based on the number of legs, in an in-use position. FIG. 3 shows stair slide assembly 100 having legs 140*a-d* mounted to the underside, mounting surface of slide 110 and additional legs 140*e-f* mounted to the underside, mounting surface of landing 150. Legs 140*a-d* are perpendicular to the ground or stair/step that each is in contact with in order to ensure optimum surface area contact with the underside of each leg.

Figure 4:
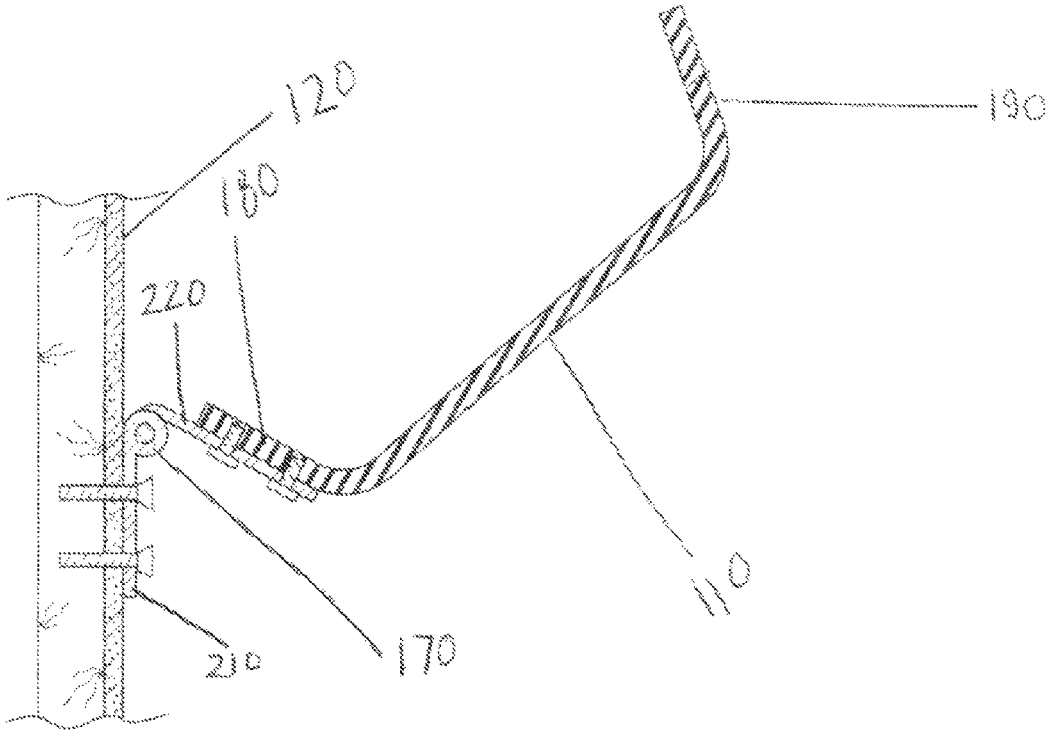
FIG. 4 is a close up fragmentary cross sectional view of the slide portion of the stair slide assembly along line 4-4 of FIG. 1 depicting the mechanism for mounting the stair slide assembly to the wall.

FIG. 4 is a close up fragmentary cross sectional view of the slide portion of the stair slide assembly 10 along line 4-4 of FIG. 1 depicting slide 110 being rotated from an in-use to a not-in-use position using mounting apparatus 170. Stationary portion 210 of mounting apparatus 170 is mounted to wall 120 using threaded screws, or other mounting means, while pivoting portion 220 is mounted to the side wall 180. The mounting apparatus 170 allows the stair slide assembly 100 to easily transition from an in-use position where the slide 110 is oriented substantially perpendicular to the wall 120 to a not-in-use or stowed away position where the slide 110 is oriented substantially parallel to the wall 120.

Referring again to FIG. 1, the stair slide assembly may be quickly assembled and installed by attaching at least two mounting apparatuses 17 to one side wall using threaded screws or the like. Preferably, the stationary portion of at least a first and second mounting apparatus are attached along two points of the wall. Thereafter, the pivoting portion of the first mounting apparatus may be attached to the upper end of side wall 18 and the pivoting portion of the second mounting apparatus may be attached to the lower end of side wall 18. The landing 15 may then be non-permanently attached by aligning a portion of Velcro® applied on the underside of the lower edge of the slide to a portion of Velcro® applied on an edge of the landing. In this way, a cushion-like surface is provided for the child or person to land on which can be removable when the stair slide assembly is not in use.

In practice, the stair slide assembly remains in the stowed away position when the slide is not in use. This enables the user to keep his/her staircase or inclined surface clear for normal use. The stowed away position of the stair slide assembly is supported by at least one leg 20, as described above, which extends downward such that the underside of the leg is in contact with the stair or floor. Several other features may be used to ensure the stair slide assembly can be maintained in its stowed away position, such as one or more latches mounted on the wall which comes in contact with side wall 19 and/or the underside of slide 11.

When the stair slide assembly is in an in-use position, the child may sit or rest upon seat 16 of slide 11 and grip one or both side walls while he begins his descent along the length of the slide, from the upper portion of the slide, to the middle portion of the slide, and finally to the lower portion of the slide, the lower edge of which is connected to the landing 15. The child may then utilize the open portion of the stairway to ascend the stairs and start over again.

It is thus an advantage of the present invention to provide a slide assembly which will mount along a staircase or inclined surface which leaves the remainder of the staircase available for normal use.

Figure 5:
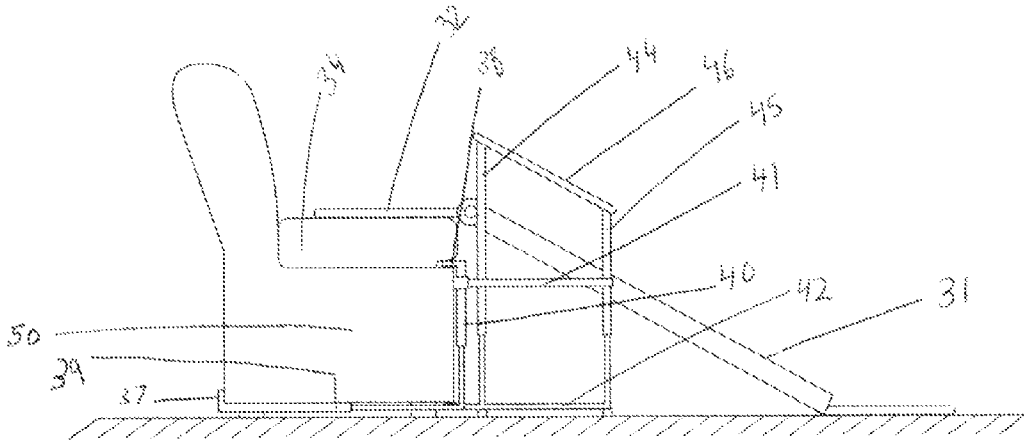
FIG. 5 is a side view of the couch slide assembly.
Figure 6:
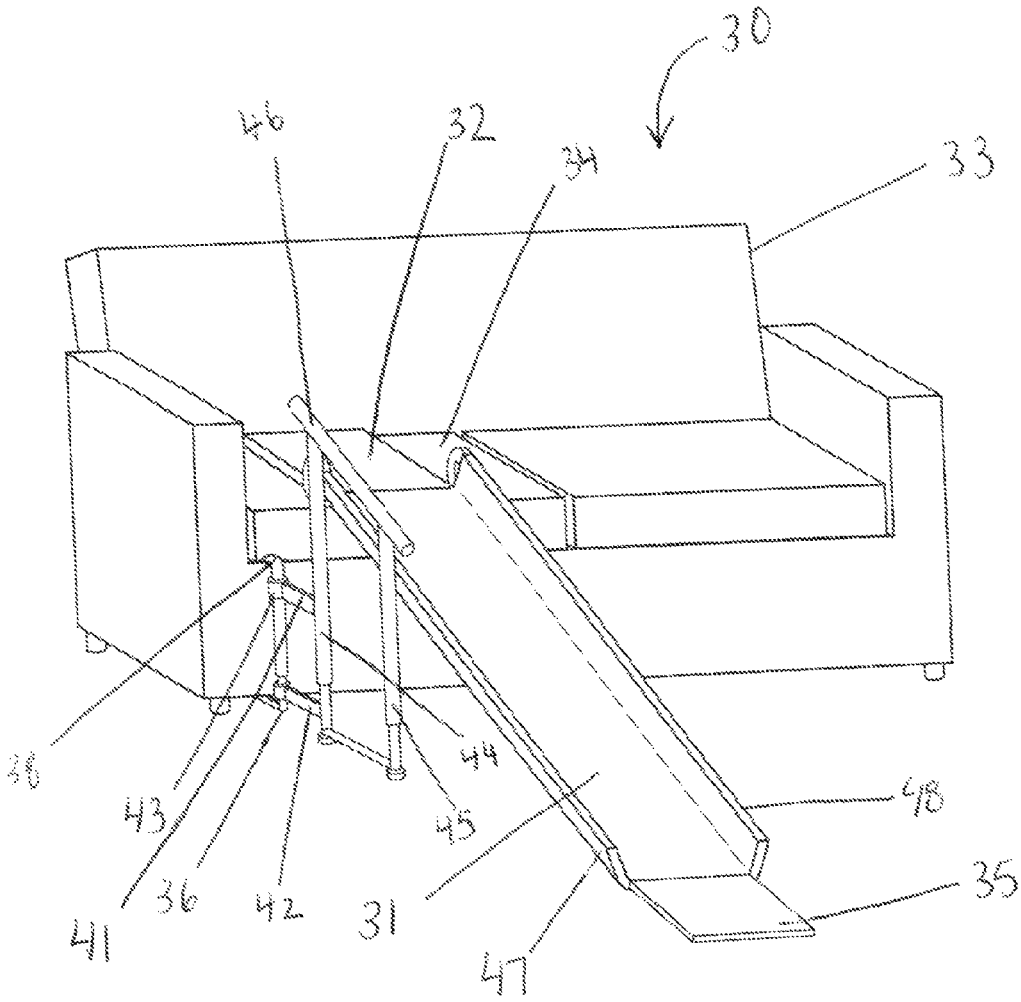
FIG. 6 is a perspective view of the couch slide assembly.

FIGS. 5 and 6 depict another embodiment of a slide assembly which can be mounted to a piece of furniture such as a couch or a chair. The slide 31 used in the couch slide assembly 30 is substantially the same as slide 11 which is used for the stair slide assembly 10. A securing attachment seat 32 may be connected to slide 31 of the couch slide assembly 30. Preferably, the underside of the securing attachment seat 32 has rubber or silicon grips, teeth or other means for preventing the securing attachment seat and slide connected thereto from sliding off cushion 34. Securing attachment seat 32 is preferably connected to slide 31 using one or more hinges secured to the underside of both surfaces.

FIGS. 5 and 6 depict clamp 36 which is mounted to and extends from the back of the couch 30 along the underside of the couch and up the front end of the couch. The various segments or portions of the clamp are positioned to securely mount the slide to the couch, as explained in more detail. Clamp 36 includes end portions 37 and 38 and between these end portions an underside portion 39 and a front portion 40. Underside portion 39 is configured to extend across the depth of the couch and terminate at vertically oriented end portion 37. Portion 37 is positioned to extend upward to secure clamp 36 to the couch base/body 50 in conjunction with the portion 38. Front portion 40 of the clamp is configured to extend upwards from underside portion 39 along the length of the base and terminate at end portion 38. Portion 38 is positioned to extend above the base/body of the couch 50 to secure clamp 36 to the couch base/body. Cushion 34 preferably is placed on top of portion 38 such that it cannot be seen when the clamp is in use, thereby improving the aesthetics of the slide. The portion of the clamp in contact with the base/body of the couch may be lined with a protective material such as silicon or rubber to prevent damage to the couch base. Alternatively, only the portion of the clamp which is in contact with the corners of the couch base may be lined with the protective material. Clamp 36 is configured to be adjustable in height and depth, as well known to one of skill in the art, and therefore is designed to accommodate couches and other furniture pieces which differ in size.

Front portion 40 of clamp 36 is configured to have one or more socket points or apertures which are adapted to receive one or more horizontal supports 41, 42, shown in FIG. 5. Alternatively, as shown in FIG. 6, horizontal supports 41 and 42 may be secured to front portion 40 using a ring or square fitting which is adapted to be permanently attached to the horizontal supports. As shown in FIG. 6, the horizontal supports are adapted to fit within slots present in extendable leg 44. Extendable legs 44 and 45 are shown as telescopic legs in FIG. 6, but may also extend in length by unfolding sections of the leg such as in an accordion-like structure. For added support, horizontal supports 41 and 42 may be positioned to lie adjacent to extendable legs 44 and 45, as is shown in FIG. 5. In this embodiment, the horizontal supports may be configured to mate with the extendable legs by using curved notches molded in the mating shape of the portion of the extendable legs which is to be mated to the support. Alternatively, a plastic clamping device may also be used to secure the horizontal supports to each extendable leg anywhere along the vertical length of the extendable legs. In this way, the couch slide assembly is designed to accommodate furniture pieces and couch bases having differing heights and depths.

In both embodiments, a handle bar 46 is configured to attach to the upper end of each extendable leg. The extendable legs are configured to securely attach to side wall 47 by fitting within notches made on the outer surface of side wall 47. It should be understood that other well known mechanisms can be used in addition to the notches or in place of the notches, such as clamps, screws, or the like. The handle bar, extendable legs, horizontal supports and clamp 36 are shown on one side of the slide 31. However, it should be understood that the same elements may be used on the other side of slide 31 to effectively secure slide 31 to couch 30. Clamp 36 and the parts which are connected thereto may be formed out of a variety of materials, including plastic and metal, such as steel or an alloy thereof.

The slide 31 preferably has a smooth unobstructed surface for ease of descent of a person or object along the slide. The slide 31 may also be assembled in parts or sections for ease of packaging. When the slide 31 is provided in sections, it can be assembled by providing a slot in one piece which is configured to fit a tongue which is made part of another piece such that each piece can be fitted together to form a varying length slide. The couch slide assembly 30 may include a seat located on the top surface of the upper end of the slide 31. The seat may be a gripping surface applied to the slide in order to provide friction for a child to sit before he begins his descent along the slide. For example, the gripping surface may be soft rubber material adhered to the slide surface, a ribbed material adhered to the slide surface, or the like. The securing attachment seat may similarly contain a gripping surface applied to its outer surface to provide friction for a child to sit before he begins his descent.

In practice, a person or child may climb onto a couch or other furniture piece fitted with the couch slide assembly 30. When the child is smaller in size and/or the furniture piece is too large for the child to climb, a stool may be used to assist the child in reaching the top of cushion 34. The child may sit on the securing attachment seat 32 before he begins his descent along the length of the slide 31. The child may also grip handle bar 46 for stability as he descends along the slide. Extendable legs 44 and 45 which are secured to both the slide 31 and the clamp 36 provide stability to the couch slide assembly 30 such that when the slide is in use, the assembly will stay in place and remain secured to the couch or other furniture piece. The child ends his descent at landing 35 which provides a cushioned surface for the child to land on.

In one embodiment, the couch slide assembly and stair slide assembly may be sold in a kit together having one slide incorporating the features of both the couch slide assembly (slide 31) and stair slide assembly (slide 11) and including the mounting and stabilizing means described above for both assemblies in one box. In this way, the user may use the kit for any general indoor use on a rainy or snowy day.

While several particular forms of the invention have been illustrated and described, it will be apparent that various modifications and combinations of the invention detailed in the text and drawings can be made without departing from the spirit and scope of the invention. For example, references to materials of construction, methods of construction, specific dimensions, shapes, utilities or applications are also not intended to be limiting in any manner and other materials and dimensions could be substituted and remain within the spirit and scope of the invention. Accordingly, it is not intended that the invention be limited, except as by the appended claims.

What is claimed is:

1. A slide apparatus adapted to mount to a vertical wall located adjacent to a stairway, the stairway having an upper portion, a lower portion, and a middle portion between the upper and lower portions, where each of the upper portion, middle portion and lower portion of the stairway comprises one or more steps and where the upper portion of the stairway is adjacent to an upper portion of the vertical wall, the middle portion of the stairway is adjacent to a middle portion of the vertical wall, and the lower portion of the stairway is adjacent to a lower portion of the vertical wall, the slide apparatus comprising:

a) a slide member having along its length an upper portion, a lower portion and middle portion between the upper and lower portions, and comprising a base and a first wall, the first wall being joined lengthwise to the base to form an angle between the base and the first wall;

b) a first mounting apparatus for securing an upper portion of the slide member to the upper portion of the vertical wall, the first mounting apparatus being securable to the upper portion of the vertical wall and secured to the upper portion of the slide member; and c) a second mounting apparatus for securing the lower portion of the slide member to the lower portion of the vertical wall, the second mounting apparatus being secured to the lower portion of the slide member, wherein the first and second mounting apparatuses allow for the pivotal movement of the slide member from a position such that the slide base is substantially parallel to the vertical wall to a position such that the slide base is substantially perpendicular to the vertical wall.

2. The slide apparatus of claim 1, wherein the slide base has an underside surface which faces the steps when the slide member is in an in-use position substantially perpendicular to the vertical wall.

3. The slide apparatus of claim 2, wherein the underside surface of the slide base comprises one or more legs along the length of the slide member, the one or more legs being capable of extending and retracting in length, wherein when the slide base is in the in-use position substantially perpendicular to the vertical wall, the one or more legs are extended to be in contact with one or more steps in the upper portion, middle portion or lower portion of the stairway.

4. The slide apparatus of claim 3, wherein when the one or more legs are extended to be in contact with the one or more steps in the upper portion, middle portion or lower portion of the stairway in the in-use orientation, the one or more legs are oriented substantially perpendicular to the one or more steps.

5. The slide apparatus of claim 4, wherein the one or more legs mounted to the underside surface of the slide base are pivotable between a position substantially perpendicular to the underside surface of the slide base and a position substantially parallel to the underside surface of the slide base.

6. The slide apparatus of claim 3, wherein when the slide base is in a not-in-use position that is substantially parallel to the vertical wall, the one or more legs are foldable to a position substantially parallel to the underside surface of the slide base.

7. The slide apparatus of claim 1, wherein the one or more legs are mounted to the underside surface of the slide base in at least one or more of the upper portion, lower portion and middle portion of the slide member.

8. The slide apparatus of claim 1, wherein the first and second mounting apparatus individually comprises a hinge.

9. The slide apparatus of claim 1, further comprising a third mounting apparatus arranged for securing the middle portion of the slide member to the middle portion of the vertical wall, the third mounting apparatus being secured to the middle portion of the first wall of the slide member and securable to the middle portion of the vertical wall.

10. The slide apparatus of claim 1, further comprising a landing means, wherein the lower portion of the slide base comprises a lowermost edge across a width of the slide base which is adapted to attach the landing means to the slide base.

11. The slide apparatus of claim 10, wherein the landing means comprising a cushion-like material.

12. A slide apparatus adapted to mount to a couch seated on a floor surface, the couch comprising a body and a cushion, the body having a front portion, an underside lying underneath the couch, and a back portion, and the cushion being removably positioned on top of the body, the slide apparatus comprising:

a) a slide member comprising a base and a first wall, the first wall being joined lengthwise to the base to form an angle between the base and the first wall;

b) one or more legs configured to attach to the first wall;

b) one or more clamps having two end members and between these end members a first clamp portion configured to adjustably extend across the depth of the couch along a couch underside and a second clamp portion configured to adjustably extend upwards from the first clamp portion along the front portion of the body to the top of the body; and c) one or more horizontal supports configured to attach on one end to the one or more legs and on the other end to the one or more clamps, wherein during use a first portion of the slide member rests on the cushion and a second portion of the slide member rests on the floor surface.

13. The slide apparatus of claim 12, wherein the second clamp portion includes one or more apertures adapted to receive the one or more horizontal supports.

14. The slide apparatus of claim 13, wherein the one or more legs each include one or more apertures adapted to receive the one or more horizontal supports.

15. The slide apparatus of claim 12, wherein the one or more legs are extendable and retractable in length.

16. The slide apparatus of claim 12, wherein the first wall comprises one or more notches molded into a mating shape of the one or more legs such that the one or more legs can be mated with the first wall.

17. The slide apparatus of claim 12, wherein a third portion lies at an angle between the first portion and the second portion when the slide apparatus is mounted to the couch.

18. The slide apparatus of claim 12, further comprising a handle bar configured to attach to an upper end of the one or more legs.

19. The slide apparatus of claim 12, wherein the second portion of the slide member comprises a cushion-like material.

20. The slide apparatus of claim 12, wherein the first portion of the slide member has a surface comprising rubber or silicon grips to prevent the slide member from sliding off the couch cushion.

* * * * *